United States Patent [19]

Dotsko

[11] 4,206,574

[45] Jun. 10, 1980

[54] LAPPING BLOCK FOR CURVED SURFACES

[75] Inventor: Martin Dotsko, Binghamton, N.Y.

[73] Assignee: The Singer Company, Binghamton, N.Y.

[21] Appl. No.: 945,808

[22] Filed: Sep. 26, 1978

[51] Int. Cl.[2] ..... B24D 15/00

[52] U.S. Cl. ..... 51/363

[58] Field of Search ..... 51/141, 358, 363, 361, 51/372, 375, 391, 392, 393

[56] References Cited

U.S. PATENT DOCUMENTS

| | | | |
|---|---|---|---|
| 752,475 | 2/1904 | Smith | 51/361 |
| 1,181,123 | 5/1916 | Edenborough | 51/392 X |
| 1,570,177 | 1/1926 | Pointer | 51/391 X |
| 2,214,515 | 9/1940 | Vanderveer | 51/391 |
| 3,030,742 | 4/1962 | Costello | 51/391 |
| 3,167,889 | 2/1965 | Jacobi | 51/141 |
| 3,517,466 | 6/1970 | Bouvier | 51/358 |
| 3,900,976 | 8/1975 | Kitts | 51/391 X |
| 4,071,983 | 2/1978 | Thielen | 51/393 |

*Primary Examiner*—Gary L. Smith
*Assistant Examiner*—Robert P. Olszewski
*Attorney, Agent, or Firm*—James C. Kesterson; Jeff Rothenberg

[57] ABSTRACT

Apparatus for abrading or polishing a spherical or other curved surface is disclosed. This apparatus includes a support base which is held and manipulated by an operator. A multiplicity of dowels having various lengths are permanently attached perpendicular to a surface of the support base. The length of the dowels is selected such that the unattached ends of the dowels defines a surface which conforms to the curved surface to be abraded or polished. A sheet of material for abrading or polishing the curved surface is stretched over the unattached ends of the dowels such that when in operation the working sheet also conforms to the surface. Pads may be included on the ends of the dowels which support the working sheet to provide resilience.

6 Claims, 5 Drawing Figures

LAPPING BLOCK FOR CURVED SURFACES

ACKNOWLEDGMENT OF GOVERNMENT RIGHTS

The Government has rights in this invention pursuant to Contract No. N61339-75-C-0009 awarded by the Department of the Navy.

BACKGROUND OF THE INVENTION

This invention relates broadly to abrading, sanding or polishing devices and more specifically to a lapping block for shaping and finishing the curved surface on a work piece. In particular, this invention relates to a lapping block for sanding and polishing the spherical surface of a projection screen used on modern and sophisticated aircraft simulators.

Various devices for finishing plane and in some instances, curved surfaces, be they concave or convex are known. In this connection, a simple block of wood with a piece of sand paper or emery cloth wrapped around has served as an apparatus for such finishing. For example, U.S. Pat. No. 752,475 issued to J. C. Smith on Feb. 16, 1904 disclosed an abrading tool for use with sand paper or emery cloth. This tool included a base with a handle as well as short bristles of brush tufts located between the block base and the sheet of emery cloth or paper. The tufts or short bristle provided a yielding or resilient backing which allowed an irregular or uneven surface to be readily smoothed by forcing the emery cloth into the hollows of the irregular surface. These tufts also yielded to any projection in the work piece and thereby permitted the emery cloth to slide over these projections. In this manner, the tufts help to achieve contact between the emery cloth and the work piece at all times.

According to another U.S. Pat. No. 2,214,515 issued to J. W. Vanderveer on Sept. 10, 1940, a block for abrading plane or curved surfaces is disclosed. According to this patent, a sanding block having an abrasive material attached to one face is constructed of narrow strips which are separated by a space or saw kerf except for a small portion. The space between the strips allows the face of the block having the abrasive material attached thereto to be readily formed into convex or concave surfaces. These surfaces are selectively curved along one axis such that they conform to the shape of the piece of work being finished. Narrow strips making up the block may also be completely separated to provide a method of easily adjusting the size of the sanding block.

Still another U.S. Pat. No. 2,434,581 issued to O. Ottoson on Jan. 13, 1948, discloses a holder for an abrasive material such as steel or brass wool. This patent discloses a base for holding the steel wool and includes a long handle so that a surface such as a floor can be scrubbed or cleaned while standing and without requiring contact of the hand and the steel wool.

U.S. Pat. No. 3,030,742 issued to W. T. Costello on Apr. 24, 1962, discloses a resilient pad suitable for use as a backing pad for hand sanding in an automobile body painting shop, etc. This flexible and resilient pad provides a means for achieving the superior finish of hand sanding while still providing a means for preventing the hands of the user from becoming raw and sore from constant contact with the sand paper. It will be appreciated, however, that this pad is only useful in final finishing and is not suitable if extensive abrading or removal of material is required.

From the above discussions, therefore, it will be appreciated that these various prior art sanding and abrading blocks suffer several disadvantages. As an example, these blocks are not suitable for extensive abrading of a complicated concave or convex surface without constant monitoring and manipulation to assure that the surface is being sanded uniformly. This is because, a flat abrading or sanding sheet or even a abrading or sanding sheet which curves in one plane cannot maintain total contact with the surface of a complex curved work piece. A second disadvantage, is that since sanding or abrading blocks require pressure to be exerted upon the block in order that the surface of the work piece can be quickly abraded, attempting to sand or lap a surface which is convex or concave can result in the curvature of the surface becoming distorted because of flat spots or other irregulatires due to unequal pressure.

It is therefore an object of this invention to provide an apparatus which allows the operator to sand or abrade a complex curved work piece without creating flat spots or other surface irregularities.

Another object of this invention is to provide a lapping block which will allow faster cutting or abrading of the surface while applying similar or less pressure to the sanding apparatus than is required in conventional sanding blocks.

A still further object is to provide an apparatus which will cause the sanding paper or emery cloth or abrading material to conform uniformly to the work surface.

A still further object is to provide a tool the employment of which on an uneven surface will allow the surface to be uniformly smoothed or rubbed.

Another object of this invention is to provide a tool which is inexpensive to manufacture and easy to use.

The goal of achieving greater realism in aircraft simulation and training units, has resulted in a need for complex and truly remarkable visual systems which are used with these training simulators. These visual systems must display to the trainee pilot a scene which substantially duplicates the scene the pilot would see in real life if he were flying the actual aircraft. To this end, the optics necessary for presenting the desired scene have become more and more complex. Consequently, wide angle displays using large curved mirrors and display screens have been developed. To achieve the desired realism and avoid distortions due to flaws and irregularities in the viewing surfaces, great care must be taken in manufacturing and finishing these viewing surfaces. In systems having small viewing surfaces, proper finishing is not overly difficult. However, certain of the new and sophisticated larger aircraft simulators having full view visual systems use spherical surfaces which must be precisely finished and polished. It will be appreciated, that none of the blocks used for hand abrading, lapping and polishing available heretofore were designed for the precision required for these complex and spherical viewing surfaces. It is therefore, another object of this invention to provide an apparatus which can be used in combination with sanding paper or emery cloth for abrading a spherical surface to a precise curvature.

SUMMARY

To accomplish the above mentioned objects as well as other objects which will become evident from the following drawings and detailed description, the present invention provides apparatus for supporting a sheet of working material used in preparing a surface of a work piece. This application includes a support member which has a size and shape suitable for being handled and manipulated by an operator. The support member includes an upper surface to which may be attached a handle or other means of grasping the support member. A multiplicity of dowels are attached at one of their ends perpendicular to a second surface of the support member in a selected pattern such as for example, in a straight line along one axis of the support member and in a staggered line along a second axis. The length of the dowels are selected such that the surface defined by the unattached end of the dowels conforms (that is can provide substantially total contact with) the surface of the work piece. A sheet of working material such as emery cloth or a polishing cloth is secured to the support member and positioned over the dowels such that the working side of the sheet defines a surface which also conforms to the surface of the work piece so that the working surface may be placed in substantially total contact with the surface of the work piece.

Accordingly, the above mentioned object and subsequent description will be more readily understood by reference to the following drawings wherein:

DESCRIPTION OF THE INVENTION

In accordance with various features of the invention, a lapping block for use with a sheet of working material such as emery cloth, sand paper or the like is provided. The lapping block includes a base member having upper and lower sides. In the illustrated embodiment, the base member is shown as having a rectangular shape however, it will become clear hereinafter that the base member could be substantially any desired shape including, for example, circular. The upperside of the base member may be attached to the lowerside of a backing plate which is cut and shaped similarly to the base member. The upperside of the backing plate has attached thereto a handle which allows the operator to grasp the lapping block during use. The underside of the base member includes a multiplicity of dowels which are in a line along a first axis and staggered along a second axis, which second axis is perpendicular to the first. The dowels vary in length such that the ends of each dowel define a surface which conforms to the shape of the surface sought to be lapped or abraded so that the surface defined by the dowels may be placed substantially in total contact with the surface of the work piece. A pad or cushion is attached to the end of each dowel. This allows the dowels to be made from a very hard material including hard woods or metals without creating a risk of damaging or marring the work piece. The edges or ends of the emery cloth or sand paper are drawn around the sides or ends of the base and backing plate and they are attached to the upper surface of the backing plate in order to hold the abrading material securely during the lapping operation.

Figure 1:
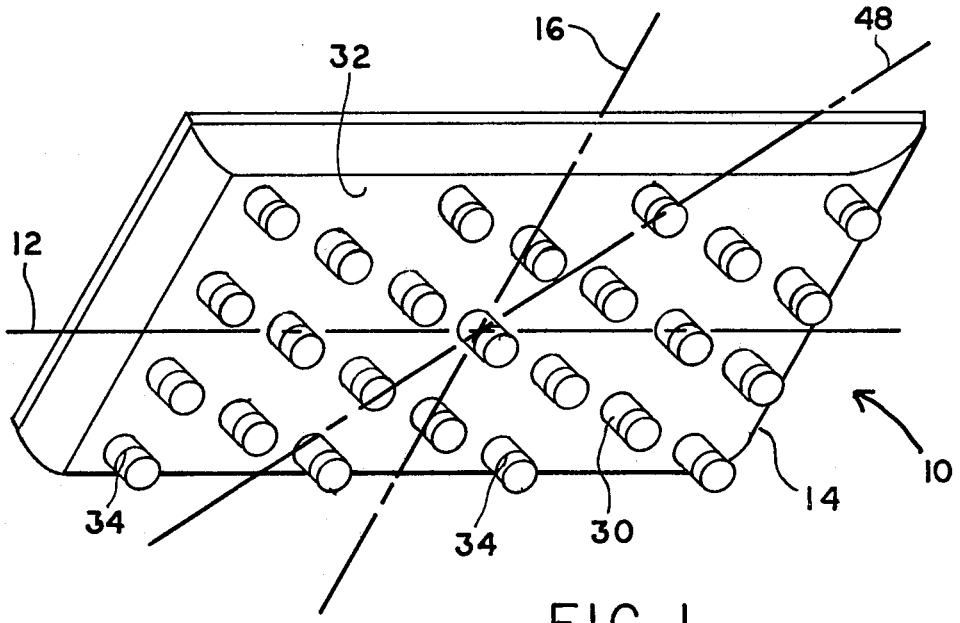
FIG. 1 is a prospective view showing the underside of a lapping block constructed in accordance with the present invention.

Referring now to the drawings, a bottom perspective view of lapping block 10 is shown in FIG. 1. Logitudinal axis 12 runs along the length of the base 14, and lateral axis 16 which is perpendicular to the longitudinal axis 12 runs parallel with the width of the base. Base 14 may be manufactured from any suitable rigid material such as wood, plastic, metal or the like. However, if added strength is desired a backing plate 18, shown more clearly in FIG. 2, may be included. The lower surface 20 of backing plate 18 is securely attached to the upper surface 22 of base 14 so that the two surfaces are coextensive. Backing plate 18 may be manufactured from any suitable rigid material such as aluminum or plastic. However, it will also be recognized by those skilled in the art that backing plate 18 and base 14 could be manufactured as separate parts as illustrated or they could be manufactured as an inttragal unit by molding, casting, etc. Additionally, of course, if base 14 is manufactured from a suitable material a backing plate may not be necessary.

Figure 2:
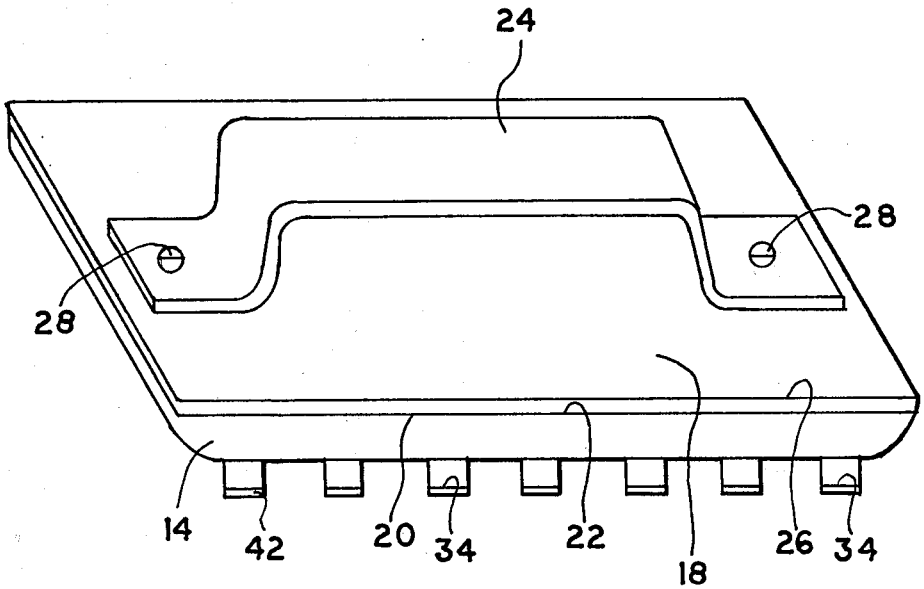
FIG. 2 is a second prospective view showing the top of the lapping block of FIG. 1.
Figure 3:
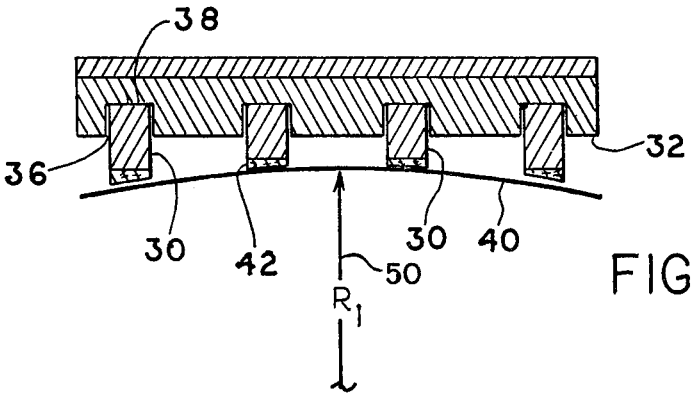
FIG. 3 is a sectional view of the lapping block of FIGS. 1 and 2.

Handle 24 as shown in FIGS. 2 and 3 which may also be manufactured from any suitable rigid material such as wood, plastic or metal provides a means for grasping the lapping block, and is secured to the upper surface 26 of plate 18 by any suitable means such as by screws 28, adhesive, welding, soldering, or the like. It will also be recognized that although a particular shaped handle is shown, other shapes would be suitable to perform this function and in fact, a separate handle is not essential since if the block is made small enough an operator could grasp the block 10 by its sides. It will be further appreciated by those skilled in the art that the base 14, plate 18 and handle 24 could be manufactured in one piece or any combination of pieces.

A multiplicity of dowels 30 having selected lengths are attached to the under surface 32 of base 14 such that ends 34 of dowels 30 conform to the shape of the work piece. As shown in FIG. 3 bores 36 having a diameter at least as large as the diameter of the ends 38 of dowels 30 are cut into the under surface 32 or base 14 in a selected pattern. In this embodiment, each bore 36 is aligned in a straight line parallel to the lateral axis 16 and in staggered lines parallel to the longitudinal axis 12. As shown in FIG. 3, end 38 of each dowel 30 is located within the bores 36 on the underside 32 of base 14 and may be held in place by force fitting the dowels in the bores, by applying a cement between the joint made by the end of the dowels and the bores, or in the case of metal dowels and metal bases, by welding or soldering. After the dowels are attached, the surface of end 34 of each dowel 30 is adjusted by lapping or other methods in order that it conforms to the shape of the work piece (not shown) which is to be abraded or polished. It will be recognized that although FIG. 1 shows alternating rows of three and four dowels in straight lines perpendicular to axis 12 and seven dowels in staggered lines perpendicular to axis 16, any number and location of dowels 30 may be used. Additionally, it will be appreciated that the staggered pattern may be accomplished perpendicular to the longitudinal axis 12 as well as perpendicular to the lateral axis 16. Further, even though a staggered pattern for dowel placement along one axis as is shown, appears to result in better abrading action, it should be recognized that any other pattern could be used including a non-staggered pattern wherein the dowels are aligned along both axes.

Figure 4:
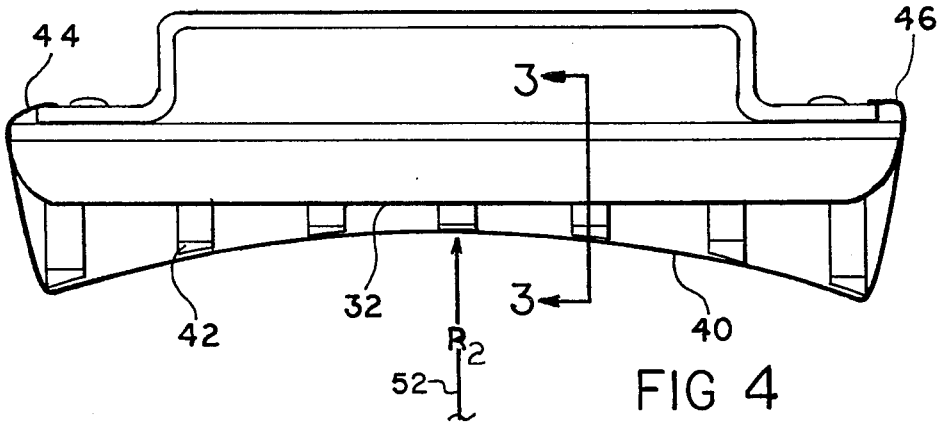
FIG. 4 is a side view of the lapping block of FIGS. 1 and 2.

A cushioned interface between the dowels 30 and the sheet 40 of abrading material is provided by a pad 42 which is permanently attached to end 34 of each dowel 30 as shown in FIG. 4. The material used for pad 42 is resilient, yet substantial enough to support the abrading sheet 40 in operation, and provide the cushioned interface in order that abrading sheet 40 may properly contact the surface of the work piece and smooth any irregularities in the surface. It also permits dowels 30 to be manufactured from a harder material than would otherwise be acceptable. Materials which could be used for pad 42 include, but are not limited to, cork, felt, nylon, plastic or the like. After pad 42 is attached to end 34 of dowels 30, the lower side of pad 42 is lapped or otherwise shaped to conform with the surface of the work piece such that it can be placed substantially in total contact with the surface of the work piece. Additionally, it will be appreciated by those skilled in the art that the entire lapping block including a handle and the dowels could be molded from plastic or some other suitable material in one piece and the dowels of each block shaped to conform to the particular surface sought to be abraded.

When it is desired that a particular surface be sanded or abraded, the dowels 30 and pads 42 must be adjusted to conform to the curvature of the surface of the work piece. This adjustment may be done by lapping, sanding or otherwise adjusting the length of the various dowels 30. Very fine adjustments and fitting the lapping block to the surface of the work piece may be achieved by varying the thickness of pads 42 so that they closely conform to the curvature of the surface of the work piece. A sheet of working material such as emery cloth, sand paper or a polishing cloth referenced in FIGS. 3 and 4 as sheet 40 is stretched across the dowels along axis 12 such that the working surface of the sheet is away from the pads and toward the surface to be sanded, abraded or polished. Ends 44 and 46 of working sheet 40 are wrapped around the sides of base 14 and backing plate 18 and attached to the upper surface 26 of plate 18 by tape, glue, tacks or other suitable means. the type of operations which is to be carried out, such as rough sanding, lapping, polishing and so forth will determine the grit, roughness or texture of the working sheet which should be employed. When the block is placed against the surface of the work piece, the pressure from dowels 30 on pads 42 cause the working sheet to conform to the curvature of the work piece surface.

As an example, and assuming that the working sheet is an abrading sheet, moving the block along axis 12 will cause small trenches to be created in the work piece as material is removed. Sanding or moving the block along axis 16 and perpendicular to the movement along axis 12 creates small trenches which are perpendicular to the trenches previously formed when sanding along axis 12. These two movements form "mountains" on the material. Sanding or abrading over the same surface on which the "mountains" were created along an axis which is rotated 45° from either axis 12 or axis 16 and shown as axis 48 eliminates the "mountains" by cutting or wearing away the tops leaving a smooth surface. A random rotational movement of the apparatus 10 against the surface of the working piece will result in fast cutting and smoothing of said surface without the creating of "trenches" and "mountains", and will also leave a smooth surface.

An embodiment of particular importance for the purposes of this invention is the selection of the length of dowels 30 such that the surface prescribed by the dowels in a spherical surface. Although the examples shown in FIG. 3 and 4 indicate a convex spherical surface it will be appreciated that by a different selection of dowel length a concave spherical surface could be polished or abraded.

Hand sanding with a backing block which does not conform to the spherical surface being worked has been found to result in flat spots and irregularities in said surface. These flat spots and other irregularities when they appear on the spherical front surface of a high gain projection screen, such as that sometimes used with flight simulators, produce uneven brightness of the projected imagery and a significant reduction in visual scene realism. Thus, for use in the visual systems of highly sophisticated aircraft simulators which require very precise and well-polished spherical surfaces, the instant tool has been found to be extremely valuable. In addition, the tool of this invention has been found to abrade and polish substantially faster and more effectively than any other previously available techniques. Referring to FIGS. 3 and 4, it can be seen therefore for spherical surfaces the radius R1 represented by arrow 50 of FIG. 3 is equal to the radius R2 shown by arrow 52 of FIG. 4. Thus, it can be seen that the apparatus 10, including its working sheet 40 which may be an abrading sheet or polishing cloth, will conform to a spherical surface having a radius equal to R1 and R2.

Figure 5:
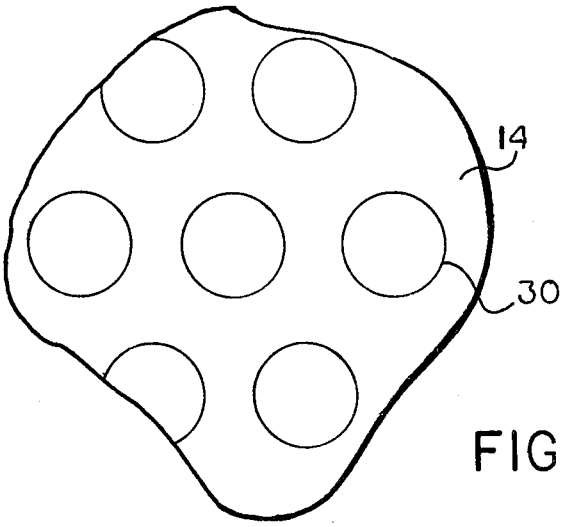
FIG. 5 is an enlarged view of the underside of another embodiment of the lapping block of FIG. 1 showing the relative locations and sizes of the dowels.

For purposes of example only, a lapping block built and successfully used comprised a ¾ inch thick fir plywood base which was 10¼ inches long by 8¼ inches wide. There were 5 rows of 7 dowels which were alternated with 5 rows of 8 dowels along the longitudinal axis. The dowels were approximately ¾ inches in diameter and made of pine. The illustration of FIG. 5 is a full scale view of a section of the apparatus of this example.

It will be understood that although a preferred embodiment of this invention has been illustrated and described, various modification thereof will become apparent to those skilled in the art, and accordingly the scope of the present invention is not intended to be limited by such specific examples except as is defined by the claims apended hereto.

What is claimed is:

1. Apparatus for use in preparing a surface of a work piece comprising:

a support member having a size suitable for being controlled and operated manually, said support member including an upper surface having means suitable for grasping said support member by said operator and a lower surface substantially parallel to said upper surface;

a multiplicity of dowels having first and second ends, said first ends of each of said dowels being fixedly attached substantially perpendicular to said lower surface of said support member in a selected pattern;

a multiplicity of pads, each having a first and second surface, the first surface of each of said pads secured to said second end of each of said dowels, the length of said dowels and the thickness of said pads between said first and second surfaces being selected to have a combined length such that said second surfaces of said pads define a selected surface; and a sheet of working material having a working side and a back side secured to said support member and positioned to cover said second surfaces of said pads such that when said back side is in contact with said second surafces of each of said pads, resilience is provided between said sheet of working material and said dowels, and said working side of said sheet also defines said selected surface, said selected surface defined by said working side of said sheet of working material suitable for contacting and preparing said workpiece.

2. The apparatus of claim 1 wherein the surface defined by said second surfaces of said pads is a curved surface.

3. The apparatus of claim 1 wherein the surface defined by said second surfaces of said pads is spherical.

4. The apparatus of claim 1 wherein said selected pattern is comprised of said multiplicity of dowels being located along one axis of said support member in a straight line, and along a second axis which is perpendicular to said first axis, said dowels along said second axis having a staggered orientation.

5. The apparatus of claim 1 wherein said working sheet is for abrading material from said surface of said work piece.

6. The apparatus of claim 1 wherein said working sheet is for polishing said surface of said work piece.

* * * * *